US007080767B2

(12) United States Patent
Kurabayashi

(10) Patent No.: US 7,080,767 B2
(45) Date of Patent: Jul. 25, 2006

(54) MOVING MECHANISM FOR MOTOR-DRIVEN STAPLERS

(75) Inventor: Atsushi Kurabayashi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 40 days.

(21) Appl. No.: 10/519,192

(22) PCT Filed: Jun. 24, 2003

(86) PCT No.: PCT/JP03/08001

§ 371 (c)(1),
(2), (4) Date: Dec. 22, 2004

(87) PCT Pub. No.: WO2004/002696

PCT Pub. Date: Jan. 8, 2004

(65) Prior Publication Data

US 2005/0230452 A1 Oct. 20, 2005

(30) Foreign Application Priority Data

Jun. 28, 2002 (JP) ..... 2002-188886

(51) Int. Cl.
*B27F 7/19* (2006.01)

(52) U.S. Cl. ..... 227/111; 227/110; 227/155; 270/58.08; 270/58.11

(58) Field of Classification Search ..... 227/110, 227/111, 131, 129, 155, 107; 270/58.11, 270/58.08
See application file for complete search history.

(56) References Cited

U.S. PATENT DOCUMENTS 4,516,714 A * 5/1985 Braun et al. ..... 227/78
5,005,751 A * 4/1991 Radtke et al. ..... 227/111
5,018,656 A * 5/1991 Phelps ..... 227/84
5,160,089 A 11/1992 Radtke et al.
5,460,314 A * 10/1995 Udagawa ..... 227/155
5,662,318 A * 9/1997 Harada et al. ..... 270/58.05
5,799,935 A 9/1998 Yamanushi et al.
5,806,750 A * 9/1998 Yamanushi et al. ..... 227/155
6,050,470 A * 4/2000 Feesenmayr et al. ..... 227/78
6,223,965 B1 * 5/2001 Nakatsuka ..... 227/111
6,641,024 B1 * 11/2003 Sato et al. ..... 227/155
6,688,589 B1 * 2/2004 Sato et al. ..... 270/58.11
6,773,005 B1 * 8/2004 Sato et al. ..... 270/58.11
6,974,066 B1 * 12/2005 Abe ..... 227/111
2001/0011667 A1 8/2001 Sato et al.

FOREIGN PATENT DOCUMENTS

JP 2-219601 3/1990

* cited by examiner

*Primary Examiner*—Scott A. Smith

(74) *Attorney, Agent, or Firm*—Morgan, Lewis & Bockius LLP

(57) ABSTRACT

A poisoning groove 16 is formed at a slide guide shaft 4, and a lever 15 of a driver unit 1 is engaged with the positioning groove to position the driver unit. A clincher unit is positioned by engaging a positioning pin 10 of a clincher unit 2 with a pin hole 13 of a slide guide table 3, the driver unit is provided with an engageable connecting pin 9, and the positioning pin and the connecting pin are driven by a cam plate 12. When the cam plate is rotated by 180 degrees, the positioning pin 10 is detached from the pin hole 13 to make the clincher unit 2 movable, the clincher unit and the driver unit are connected by engaging the connecting pin 9 with the driver unit, and the clincher unit and the driver unit are integrally traveled.

5 Claims, 5 Drawing Sheets

MOVING MECHANISM FOR MOTOR-DRIVEN STAPLERS

TECHNICAL FIELD

The present invention relates to a moving mechanism of an electric stapler, particularly relates to a moving mechanism of an electric stapler promoting positioning accuracy.

BACKGROUND ART

There is known an electric stapler device in which a plurality of electric staplers are mounted to a guide shaft or a guide rail, and the electric staplers are moved in conformity with a size of a sheet of paper to thereby change a pitch of striking staples. According to an electric stapler of this kind, a driver unit and a clincher unit are separated, the driver unit is mounted to one of two guide shafts or guide rails arranged in parallel with each other, the clincher unit is mounted to other thereof to make the driver unit and the clincher unit opposed to each other by interposing a sheet table, and the driver unit and the clincher unit are moved on the guides in synchronism with each other by a moving mechanism.

The moving mechanism is a publicly-known synchronizing mechanism in which wires or timing belts are hung around pulleys arranged at respectively both ends of the guides arranged in parallel with each other, the pulleys on a side of the driver unit and the pulley on a side of the clincher unit are connected by a single pulley shaft, and the driver unit and the clincher unit are respectively coupled to a single point of the timing belts or wires, and by driving to rotate the pulley shaft, a pair of the electric staplers symmetrically come closer to each other or remote from each other to thereby change an interval therebetween.

Although the moving mechanism of the electric stapler of the background art is constituted such that the two electric staplers symmetrically come closer to each other or remote from each other by the synchronizing mechanism using the wires or the timing belts, it takes a lot of man-hours for positioning the driver unit and the clincher unit when they are assembled, moreover in some cases, a binding failure may occur by a positional shift between the driver unit and the clincher unit caused by an ageing change.

Hence, there poses technical problems to be resolved in order to resolve a concern of a binding failure by promoting accuracy of positioning a driver unit and a clincher unit and promote productivity by facilitating assemble operation, and it is an object of the invention to resolve the above-described problems.

DISCLOSURE OF THE INVENTION

The invention is proposed to achieve the above-described object, and there is provided a moving mechanism of an electric stapler characterized in a moving mechanism of an electric stapler for traveling a driver unit and a clincher unit which are separated from each other respectively along slide guide members, constituted such that the two slide guide members are respectively formed with positioning holes or positioning grooves, the driver unit and the clincher unit are provided with locking means of slide pins or levers engaged with the positioning holes or the positioning grooves, the clincher unit and the driver unit are provided with connecting means comprising slide pins and pin holes, the driver unit and the clincher unit are formed to be able to switch to two states of connecting the driver unit and the clincher unit and releasing the driver unit and the clincher unit from being connected by moving the slide pins, switching means for driving the locking means and the slide pins are provided, by connecting the clincher unit and the driver unit and releasing the locking means from being engaged, the clincher unit and the driver unit can integrally be moved.

Further, there is provided the moving mechanism of an electric stapler constituted such that a motor-driven cam is provided to the clincher or the driver unit including the locking means and the slide pin of the connecting means, and the connecting means and the locking means are integrally driven by the motor-driven cam.

Further, there is provided the moving mechanism of an electric stapler constituted such that the slide pin of the connecting means provided at the clincher unit or the driver unit presses the slide pin or the lever of the locking means of an opposed side in connecting the clincher unit and the driver unit to release the clincher unit and the driver unit from being engaged.

Figure 1A:
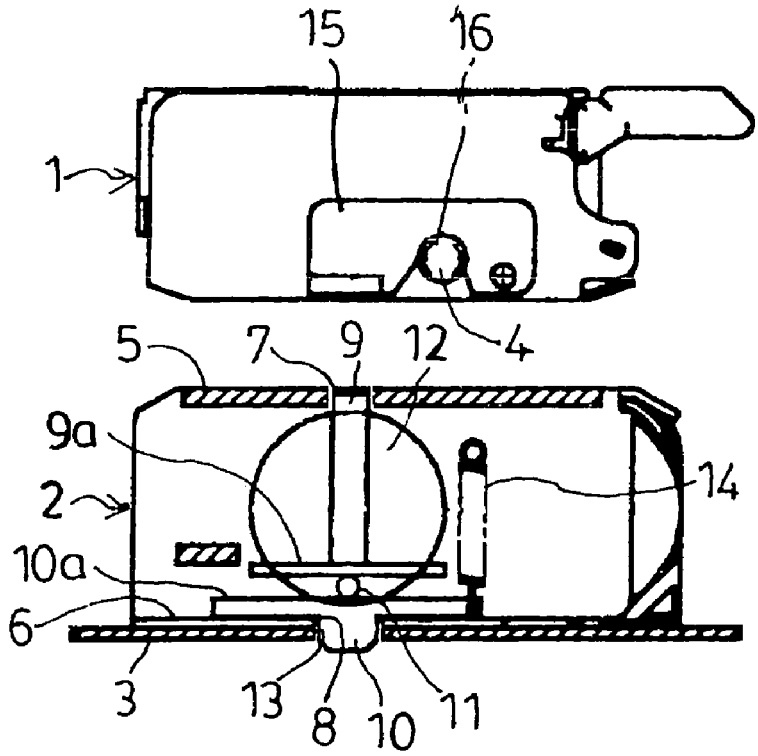
FIG. 1(*a*) and FIG. 1(*b*) show one embodiment of the invention, FIG. 1(*a*) is a side view of an initial state of an electric stapler, and FIG. 1(*b*) is a side view in moving the electric stapler.

Further, in notations of the drawings, numeral 1 designates a driver unit, numeral 2 designates a clincher unit, numeral 3 designates a slide guide table, numeral 4 designates a slide guide shaft, numeral 7 designates a pin hole, numeral 8 designates a pin hole, numeral 9 designates a connecting pin, numeral 10 designates a positioning pin, numeral 11 designates a cam pin, numeral 12 designates a cam plate, numeral 13 designates a pin hole, numeral 15 designates a lever, numeral 16 designates a positioning groove, numeral 17 designates a grooved roller, numeral 18 designates a grooved roller, numeral 19 designates a timing belt, numeral 20 designates a motor, and numeral 21 designates an arm portion.

BEST MODE FOR CARRYING OUT THE INVENTION

Figure 1B:
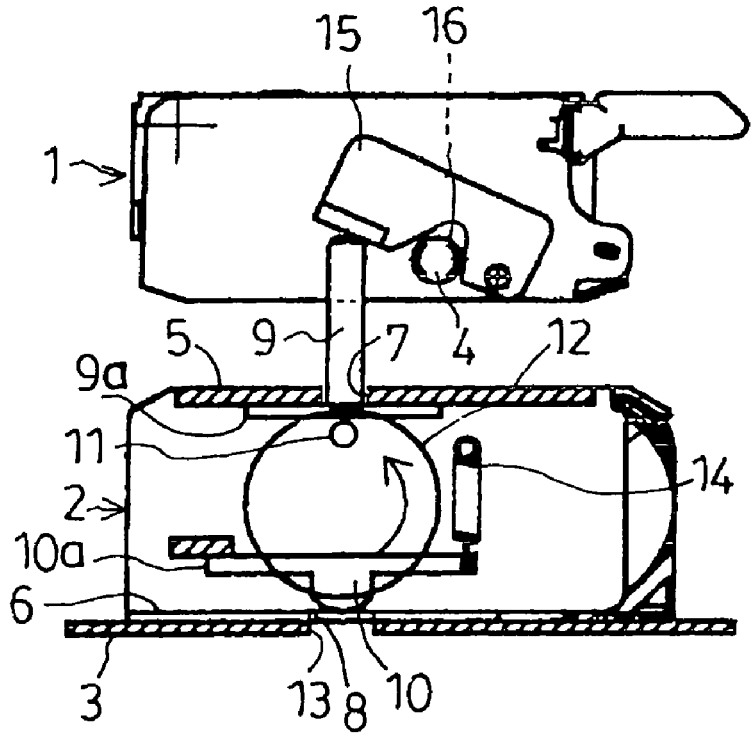

A detailed description will be given for one embodiment of the invention referring to the drawings as follows. FIG. 1(*a*) and FIG. 1(*b*) show the driver unit 1 and the clincher unit of the electric stapler, and a sheet of paper on a sheet table (not illustrated) arranged between the driver unit 1 and the clincher unit 2 is pinched to bind by the driver unit 1 and the clincher unit 2. The clincher unit 2 disposed below the driver unit 1 is mounted on the slide guide table 3 at inside of a stapler frame (not illustrated), and the driver unit 1 thereabove is mounted to the slide guide shaft 4 provided in parallel with the slide guide table 3. A driver is included at a front portion of the driver unit 1, a clincher opposed to the driver is included at a front portion of the clincher unit 2, although illustration thereof is omitted, the clincher is moved up to press the sheet to a lower face of the driver unit 1, a magazine (not illustrated) at inside of the driver unit 1 is moved up, the driver is relatively moved down to inject a staple, and a leg portion of the staple penetrated through the sheet impinges on the clincher to be folded to bend to bind the sheet.

A ceiling plate 5 and a bottom plate 6 of the clincher unit 2 are formed with the pin holes 7, 8, the connecting pin 9 for connecting with the driver unit 1 is inserted into the pin hole 7 on an upper side, and the positioning pin 10 for fixing a position of the clincher unit 2 is inserted into the pin hole 8 on a lower side. End portions of the connecting pin 9 and the positioning pin 10 are respectively provided with horizontal head plates 9*a*, 10*a*, and the head plates 9*a*, 10*a* are brought into contact with two upper and lower faces of the cam pin 11. The cam pin 11 is provided at a side face of the cam plate 12 arranged at sides of the connecting pin 9 and the positioning pin 10, and when the cam plate 12 is rotated by a motor (not illustrated), the cam pin 11 is circularly moved on a vertical plane.

In an initial state shown in FIG. 1(*a*), the positioning pin 10 is fitted to the pin hole 13 of the slide guide table 3 through the pin hole 8 of the bottom plate 6 to fix the clincher unit 2 at a predetermined position, and when the cam pin 11 is moved up by rotating the cam plate 12 as shown by FIG. 1(*b*), the positioning pin 10 is moved up by being pulled by a tension spring 14, and drawn out from the pin hole 13 of the guide table 3 to bring the clincher unit 2 into a movable state. Further, the connecting pin 9 is projected upward from the pin hole 7 of the ceiling plate 5 to move into the driver unit 1 through a pin hole (not illustrated) formed at a bottom plate of the driver unit 1. Inside of the driver unit 1 is provided with the lever 15, a front end portion of the lever 15 is opposed to the connecting pin 9, and when the connecting pin 9 is moved up, the lever 15 is upwardly pushed up by the connecting pin 9. A notched portion in a shape of a circular arc is provided on the middle portion of the lever 15, and the slide guide shaft 4 is positioned at inside of the notched portion. The slide guide shaft 4 is formed with the positioning groove 16 in a peripheral direction for fixing the driver unit 1 at the predetermined position, and in an initial state shown in FIG. 1(*a*), the lever 15 is engaged with the positioning groove 16 to fix the driver unit 1 at the predetermined position.

Figure 2A:
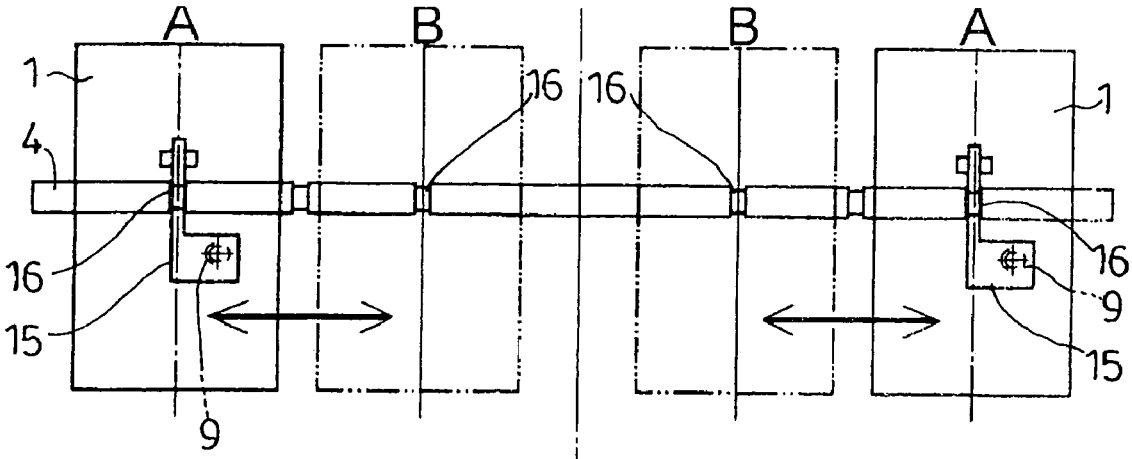
FIG. 2(*a*) and FIG. 2(*b*) show a moving mechanism of the electric stapler, FIG. 2(*a*) is a plane view of a state of fixing at A position, and FIG. 2(*b*) is a front view of the state of fixing at the A position.
Figure 2B:
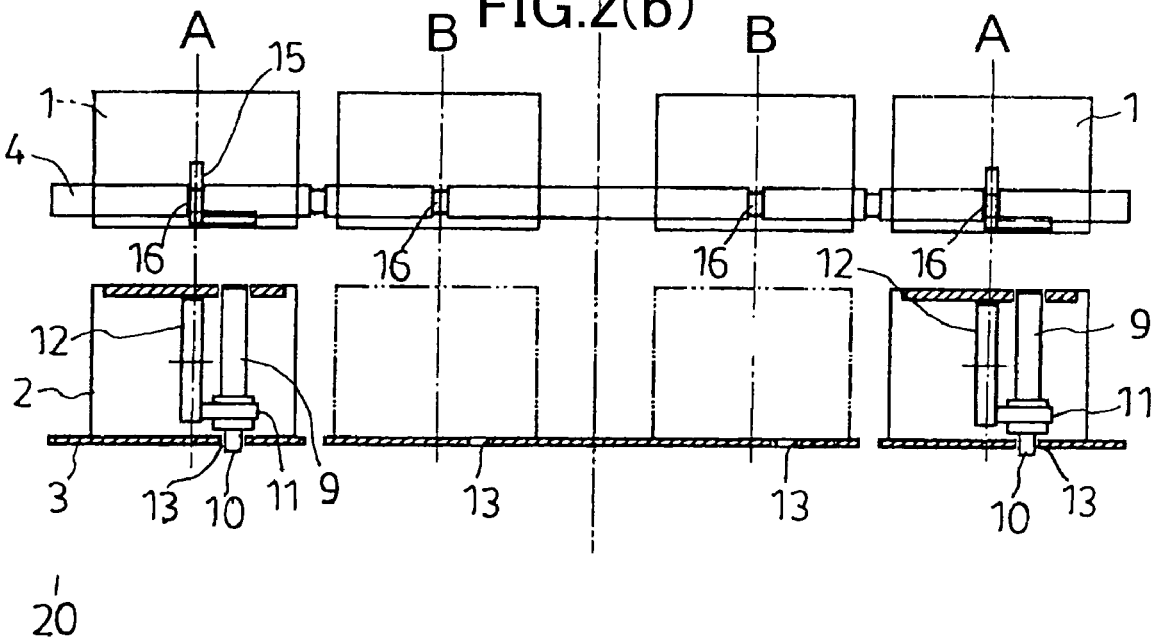

As shown by FIG. 2(*a*) and FIG. 2(*b*), the positioning groove 16 of the slide guide shaft 4 and the pin hole 13 of the slide guide table 3 are made to correspond to, for example, a binding position A of a sheet of A3 size and a binding position B of a sheet of A4 size, and at respective fixed positions, positions of the driver of the driver unit 1 and the clincher of the clincher unit 2 accurately coincide with each other.

Figure 3A:
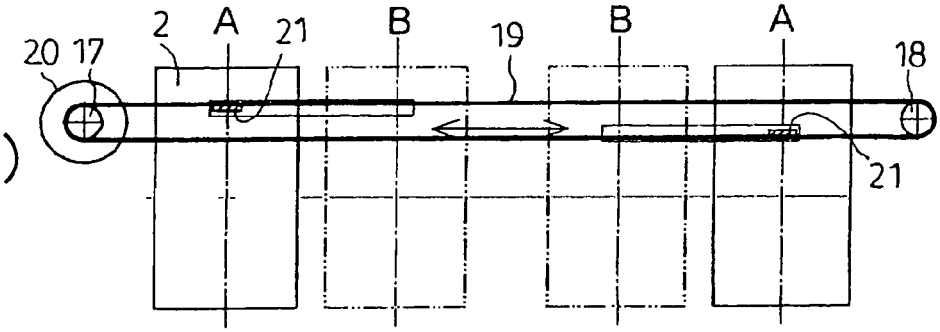
FIG. 3(*a*) and FIG. 3(*b*) show a stapler traveling mechanism, FIG. 3(*a*) is a plane view, and FIG. 3(*b*) is a front view.
Figure 3B:
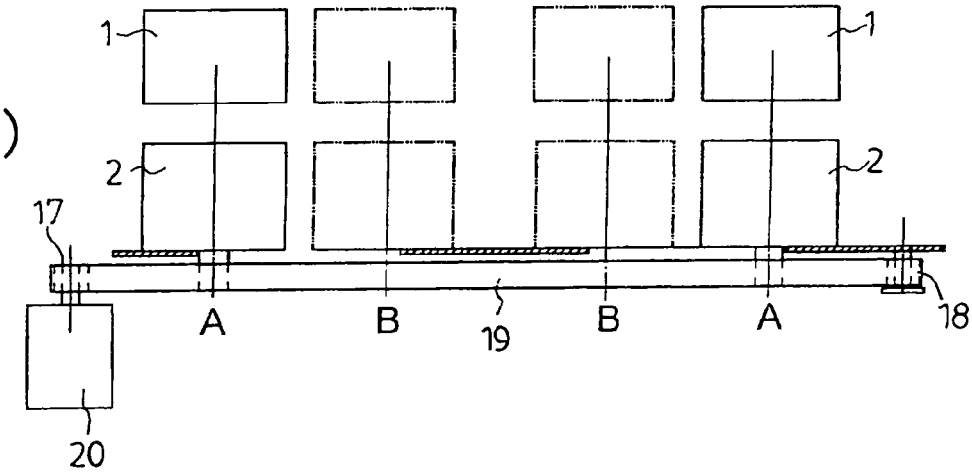

FIG. 3(*a*) and FIG. 3(*b*) show a constitution of a stapler traveling mechanism, the grooved rollers 17, 18 are arranged on a lower side of the slide guide table 3 and on outer sides of both ends of a range of traveling the electric stapler, the timing belt 19 is hung around the two grooved rollers, and the grooved roller 17 on one side is driven by the motor 20. The two clincher units 2 are provided with the arm portions 21 at respective lower faces thereof, in FIG. 3(*a*) and FIG. 3 (*b*), the arm portion 21 of the left clincher unit 2 is coupled with a depth side of a loop of the timing belt 19 and the arm portion 21 of the right clincher unit 2 is coupled with this side of the loop of the timing belt 19. Therefore, when the motor 20 is driven to rotate in the clockwise direction in FIG. 3(*a*) and FIG. 3(*b*), the left and right clincher units 2 become closer to each other symmetrically, and when the motor 20 is driven to rotate in the anticlockwise direction, the left and right clincher units 2 become remote from each other symmetrically.

Figure 4:
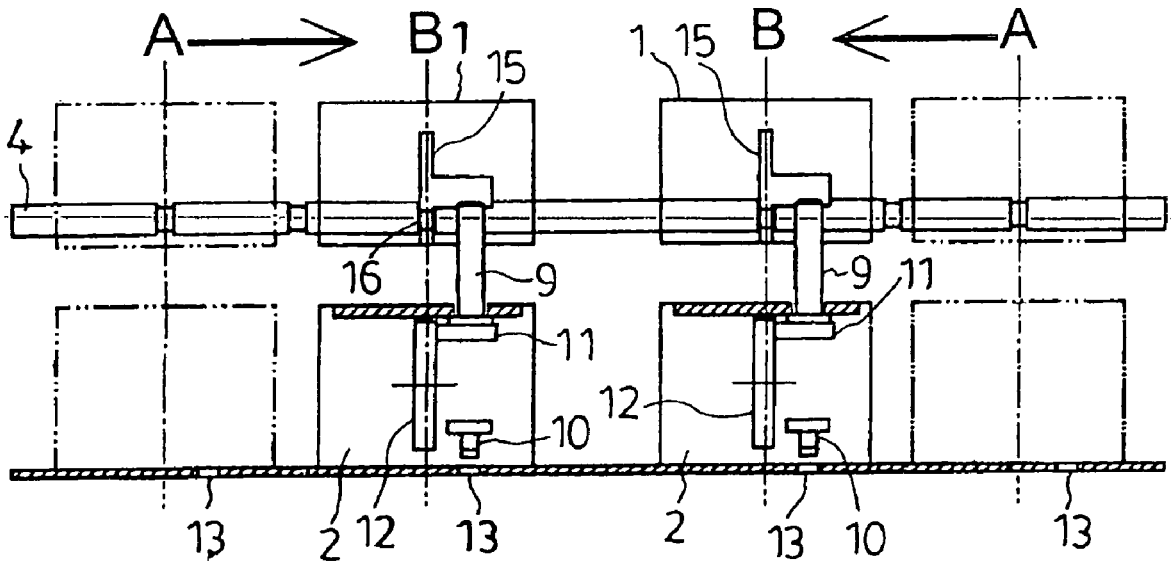
FIG. 4 shows a moving mechanism of the electric stapler, and is a front view of a state of moving to B position.

Next, operation of the moving mechanism will be explained. When the two electric staplers are moved, the cam plate 12 is rotated by 180 degrees from the initial state of FIG. 1(*a*) to bring about a state of FIG. 1(*b*) and FIG. 4. At this occasion, the positioning pin 10 is moved up to be separated from the pinhole 13 of the slide guide table 3 and therefore, the clincher unit 2 is brought into a movable state. Further, the connecting pin 9 is engaged with a pin hole (not illustrated) of the bottom plate of the driver unit 1 to connect the clincher unit 2 and the driver unit 1, the lever 15 at inside of the driver unit is moved up to release the lever 15 and the slide guide shaft 4 from being engaged, and also the driver unit 1 is brought into a movable state.

Further, when two sets of the clincher units 2 and the driver units 1 are moved respectively from A positions to B positions or from B positions to A positions by driving the motor 20 shown in FIG. 3(*a*) and FIG. 3(*b*) to stop at constant positions, and thereafter returned to the initial positions by driving to rotate the cam plates 12 by 180 degrees, the positioning pins 10 are fitted to the pin holes 13 of the slide guide table 3 to fix the clincher units 2, and the connecting pins 9 are moved down to fit the levers 15 to the positioning grooves 16 of the slide guide shafts 4 to fix the driver units 1.

Figure 5A:
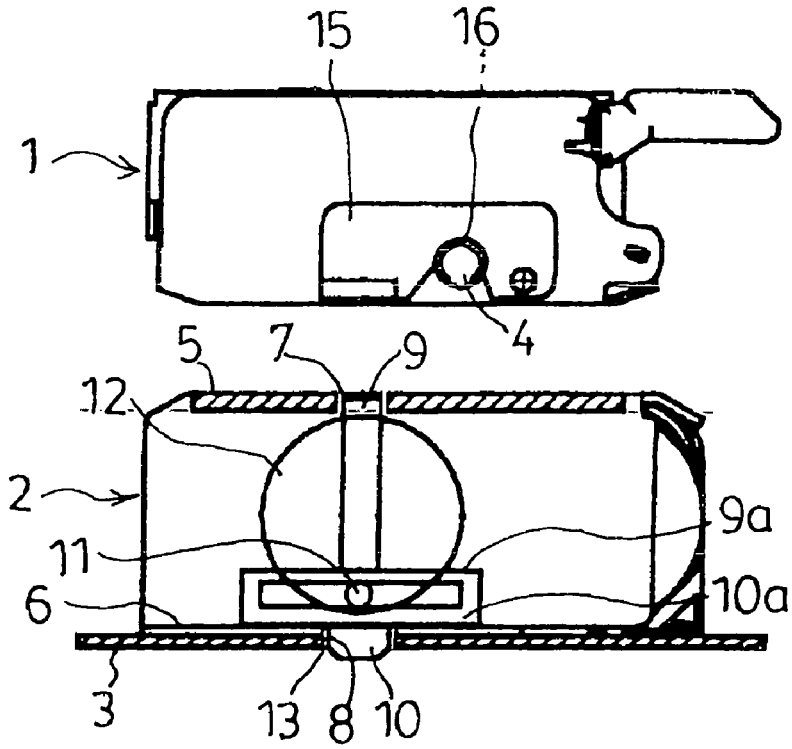
FIG. 5(*a*) and FIG. 5(*b*) show other embodiment, FIG. 5(*a*) is a side view of an initial state of an electric stapler, and FIG. 5(*b*) is a side view of a state in moving the electric stapler.
Figure 5B:
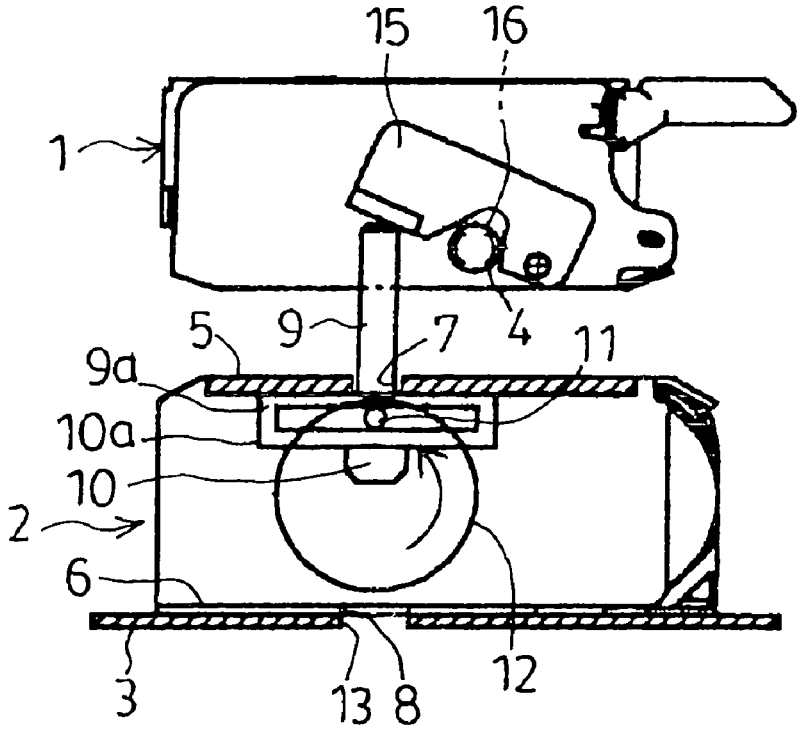

Further, although according to the above-described embodiment, the connecting pin 9 and the positioning pin 10 are separated from each other, as shown by FIG. 5(*a*) and FIG. 5(*b*), the connecting pin 9 and the positioning pin 10 may be integrated by forming a cam follower in a shape of a box by connecting the respective head plates 9*a*, 10*a* of the connecting pin 9 and the positioning pin 10. Further, the invention is not limited to the above-described embodiments but can variously be modified within the technical range of the invention and the invention naturally includes the modifications.

INDUSTRIAL APPLICABILITY

As explained above, the moving mechanism of the electric stapler of the invention is provided with the mechanism of connecting/releasing the clincher unit and the driver unit and therefore, the clincher unit and the driver unit can integrally be moved by the moving mechanism of a wire, a belt or the like arranged only on one side of the clincher unit and the driver unit, and a constitution thereof is more simplified and assembling thereof is more facilitated than those of the moving mechanism of the background art in which wires or belts are arranged on both sides of the clincher unit side and the driver unit side. Further, positioning means are provided to both of the clincher unit and the driver unit and therefore, positioning in assemble operation is simple, operability is promoted, a positioning shift is not brought about after assembling, and stability and reliability are also promoted.

The invention claimed is:

1. A moving mechanism of an electric stapler, wherein a driver unit and a clincher unit separately formed from each other are traveled along slide guide members provided in correspondence with the respective units, comprising:

positioning means formed at respectives of the two slide guide members;

locking means, provided at respectives of the driver unit and the clincher unit, for engaging with the positioning means; and connecting means for switching the driver unit and the clincher unit to two states of connecting the driver unit and the clincher unit and releasing the driver unit and the clincher unit from being connected with each other, wherein the positioning means and the locking means are released from being engaged with each other by connecting the clincher unit and the driver unit by the connecting means, and the positioning means and the locking means are engaged with each other by releasing the clincher unit and the driver unit from being connected with each other by the connecting means.

2. The moving mechanism of an electric stapler according to claim 1, wherein a motor-driver cam is provided to the clincher unit or the driver unit, and the connecting means and the locking means are integrally driven by the motor-driven cam.

3. A moving mechanism of an electric stapler, wherein the electric stapler comprises a driver unit and a clincher unit separately formed from each other, comprising:

a slide guide shaft that guides the driver unit;

a slide guide table that guides the clincher unit;

a positioning groove formed on the slide guide shaft;

a pin hole formed on the slide guide table;

a lever provided in the driver unit and including a notched portion engageable with the positioning groove;

a positioning pin provided in the clincher unit and engageable with the pin hole; and a connecting pin provided in the clincher unit and movable into the driver unit, wherein the driver unit and the clincher unit are connected when the connecting pin moves into the driver unit, wherein, when the driver unit and the clincher unit are connected, the notched portion and the positioning groove are disengaged and the positioning pin and the pin hole are disengaged, and wherein, when the drive unit and the clincher unit is disconnected, the notched portion and the positioning groove are engaged and the positioning pin and the pin hole are engaged.

4. The moving mechanism according to claim 3, wherein the clincher unit comprises cam, and wherein the positioning pin and the connecting pin are integrally driven by a movement of the cam.

5. The moving mechanism according to claim 4, wherein, when the positioning pin is driven to disengage with the pin hole, the connecting pin is driven to move into the driver unit, the lever is upwardly pushed up by the connecting pin, and the notched portion and the positioning groove is disengaged, and wherein, when the positioning pin is driven to engage with the pin hole, the connecting pin is driven to move down, the lever is downwardly moved, and the notched portion and the positioning groove is engaged.

* * * * *